US005129638A

United States Patent [19]

Durfee, Jr.

[11] Patent Number: 5,129,638

[45] Date of Patent: Jul. 14, 1992

[54] VISE-JAW EXTENSION

[75] Inventor: David L. Durfee, Jr., Meadville, Pa.

[73] Assignee: Susan M. Durfee, Meadville, Pa.

[21] Appl. No.: 634,050

[22] Filed: Dec. 26, 1990

[51] Int. Cl.[5] ..... B25B 1/24

[52] U.S. Cl. ..... 269/282; 269/283

[58] Field of Search ..... 269/271, 282, 283, 279-280, 269/284

[56] References Cited

U.S. PATENT DOCUMENTS

| | | | |
|---|---|---|---|
| 744,559 | 11/1903 | Kendrick . | |
| 800,685 | 10/1905 | Scoggins . | |
| 1,250,092 | 12/1917 | Cook . | |
| 1,961,036 | 5/1934 | Boyle | 269/282 |
| 2,741,145 | 11/1954 | Bahorik . | |
| 2,876,667 | 3/1959 | Smith . | |
| 2,880,638 | 4/1959 | Muggli et al. . | |
| 3,006,226 | 10/1961 | Poysa . | |
| 3,184,228 | 5/1965 | Chenette et al. . | |
| 3,341,190 | 9/1967 | Adamson ..... 3,397,880/081968Kuban | |
| 3,565,417 | 2/1971 | Degle | 269/284 |
| 4,078,782 | 3/1978 | Carlson . | |
| 4,216,950 | 8/1980 | Mason et al. . | |
| 4,306,709 | 12/1981 | Hurn . | |
| 4,422,629 | 12/1983 | Carlson . | |
| 4,573,669 | 3/1986 | Gerry . | |
| 4,798,371 | 1/1989 | Wallisser | 269/283 |

*Primary Examiner*—Robert C. Watson
*Attorney, Agent, or Firm*—Oliff & Berridge

[57] ABSTRACT

The invention is an improvement to machining vises that allows the effective width between the opposing jaw faces to be variably increased beyond that of the standard opposing faces of the stationary and movable jaws. To provide the increased jaw width, jaw segments having a notched reception area are received in key-ways extending laterally across extended upper surfaces of the stationary and movable jaws. At least one key-way is formed on the upper surface of the stationary jaw and at least two key-ways are formed in the upper surface of the movable jaw. The number and placement of the jaw segments are determined by the configuration of the workpiece to be machined so as to properly hold the workpiece in such a manner the machining operation is not obstructed.

37 Claims, 13 Drawing Sheets

VISE-JAW EXTENSION

BACKGROUND OF THE INVENTION

1. Field of the Invention

This invention relates to jaw extenders to extend the throat (i.e., the distance between the working surfaces of opposing jaw faces) of machinist vises to permit machining of larger workpieces that could not otherwise be held in the normal vise-jaws.

2. Description of the Related Art

It has long been recognized by those who use vises having a stationary jaw and a movable jaw to hold workpieces for performing work thereon that many workpieces are either too large or of an irregular shape such that the standard jaws of the vise are inadequate to support the workpiece. As a result, jaw keys have been provided to increase the workpiece holding capacity of the vise. Examples of vises having jaw keys are found in U.S. Pat. Nos. 800,685; 2,741,145; 3,006,226; 4,078,782 and 4,422,629.

In addition to those patents directed to extending the clamping width of vise jaws, there are a number of patents directed to auxiliary jaws for special purposes. Patents of this type include U.S. Pat. Nos. 2,876,667 and 3,184,228.

Alternative devices to expanding the width of vise jaws include configuring the machining work surface to accept specially adapted clamps for holding the workpiece in position such as disclosed in U.S. Pat. No. 744,559 and a support device that provides adaptable clamping means, such as U.S. Pat. No. 4,306,709, wherein the clamping members are rotatable on the upper surface of the jaw and each end of the jaw assembly of the movable jaw is controlled by a separate threaded screw.

Although this diverse range of solutions to providing alternative jaw facings addresses problems faced by machinists, the solutions generally address but a single problem. For example, U.S. Pat. Nos. 4,078,782 and 4,422,629 disclose devices for extending the clamping width of the vise jaws but do not address the problem of maintaining the accuracy of the jaw extensions relative to a vise datum surface or extending the lateral width of the jaw faces while maintaining matched clamping surfaces. Further, the area of contact between the vise jaw extenders and the workpiece in the '782 and '629 patents is extensive thereby limiting continuous machining operations.

SUMMARY OF THE INVENTION

Accordingly, it is an object of this invention to provide an improved vise jaw extension to increase the capacity of the vise.

Another object of the invention is to provide a means for retaining a work piece with jaw segments such that the operator is able to machine outside edges of the workpiece by strategically arranging the jaw segments to clear machining operations.

Another object of the invention is to permit the vise to be rapidly adapted to accommodate workpieces having varying shapes.

A further object of the invention is to avoid the necessity of having to remove the vise from the machine in order to clamp the oversized workpiece to the table for subsequent machining operations.

Another object of the invention is to provide a reinforced jaw extension that prevents mismatched clamping surfaces.

Another object of the invention is to provide a workpiece support device having a plurality of adjustment positions for providing selectively adjustable clamping for a workpiece over a relatively large range of workpiece widths.

Another object of the present invention is to provide an accessory apparatus for vises that enables workpieces having a width greater than that of the vise jaws to be adequately supported during machining operations.

The instant application provides vise jaw extenders that are an easily applied add-on or, in an alternative embodiment, an integral part of the basic vise. In both cases, the throat or face to face width between the vise jaws remains unchanged when the extended vise jaw system is used. The vise jaw extenders include at least a portion contacting the datum surface to maintain the accuracy of the vise.

The extended vise jaw system is comprised of at least one key-way extending laterally across the width of the upper surface of each vise jaw. Jaw segments having a bottom surface configured to be slidably received in the lateral key-ways normally having a notch at the upper portion of their face for retaining the workpiece. Further, the jaw segments have means for being fixedly retained in a desired position within the selected key-way, the form of the retention means being dependent upon the type key-way. The jaw segments are thus movable to the desired location to securely hold the workpiece while expanding the workpiece surface area capable of being machined.

BRIEF DESCRIPTION OF THE DRAWINGS

These and other objects or features of the invention will become apparent with reference to the following detailed specification and to the drawings wherein.

DESCRIPTION OF THE PREFERRED EMBODIMENTS

Figure 1:
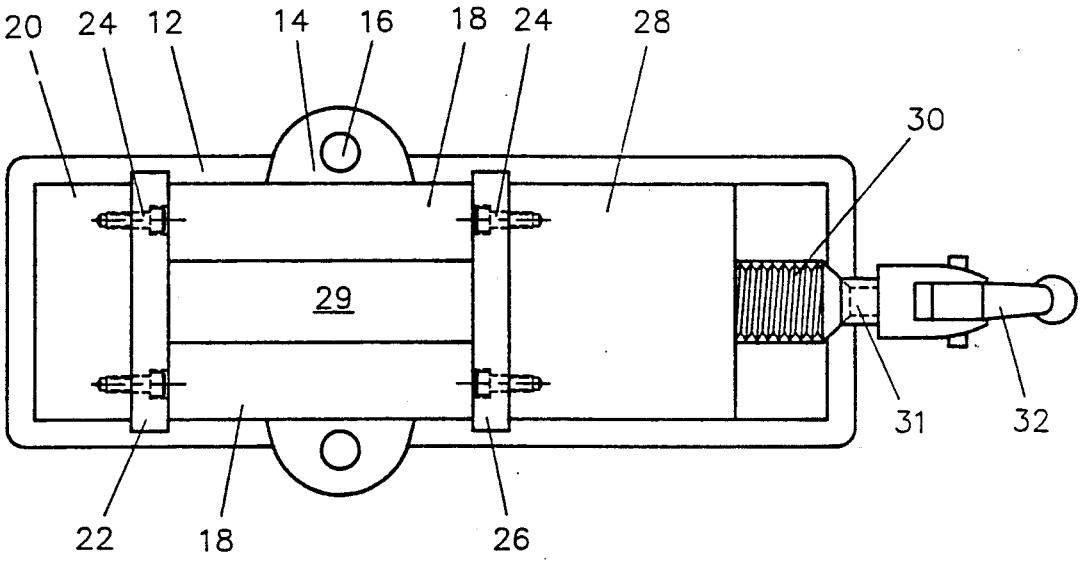
FIG. 1 (PRIOR ART)
FIG. 1 is a plan view of a vise of the type to which the invention is applied.
Figure 2:
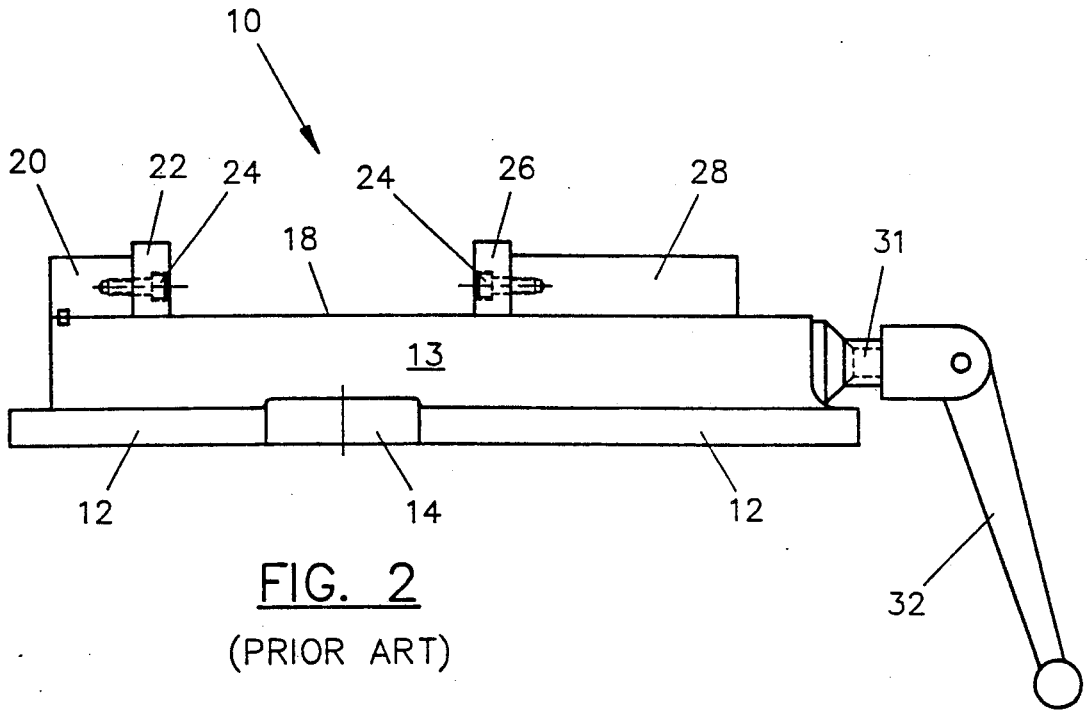
FIG. 2 (PRIOR ART)
FIG. 2 is a side elevation of the vise of FIG. 1.

A machinist vise, such as that of U.S. Pat. Nos. 2,880,638 and 3,397,880, is shown in FIGS. 1 and 2. The vise, as shown, comprises a base 12 having means for mounting the base to a machining table or other surfaces, such as ears 14, with opening 16 for receiving a bolt or similar securing means. Mounted to base 12 is a vise bed 13. At one end of bed 13 is a raised portion 20 that comprises a stationary jaw. A channel, or trough, 29, having a flat bottom surface and sides perpendicular to the bottom surface, lies along the longitudinal axis of vise bed 13. The raised portions on either side of channel 29 have flat, smooth upper surfaces which form datum surface 18.

Mounted so as to slide on datum surface 18 is movable jaw 28. Movable jaw 28 has an adjustment part (not shown) extending from its lower side that is slidably received in channel 29. Attached to the inner faces of stationary jaw 20 and movable jaw 28 are replaceable jaw plates 22 and 26, respectively. Jaw plates 22, 26 are attached to their respective jaws by means of screws 24.

One end of adjustment screw 30 is threadably received in an opening in an end of the adjustment part of movable jaw 28. At the other end of adjustment screw 30 is key 31 for receiving a handle 32. Handle 32 may be rotated manually, as shown, or mechanically to include rotation by computer controlled drive devices. Rotation of handle 32 causes movable jaw 28 to move toward or away from stationary jaw 20 depending on the direction of rotation.

This known apparatus suffers two significant disadvantages. First, the largest workpiece that may be held by the vise is defined by the maximum width to which the jaws may be opened. Thus, if it is desired to hold relatively large workpieces, the vise must be of an appropriate size. As the vise gets larger the weight increases dramatically. A second disadvantage, one that is addressed in patents such as U.S. Pat. No. 4,216,950, is that additional supports must be placed between the jaw faces to elevate the upper surface of many workpieces above the jaw level thereby permitting the upper surface of the workpiece to be machined. The invention disclosed herein overcomes these disadvantages while maintaining the accuracy of the vise.

Figure 3A:
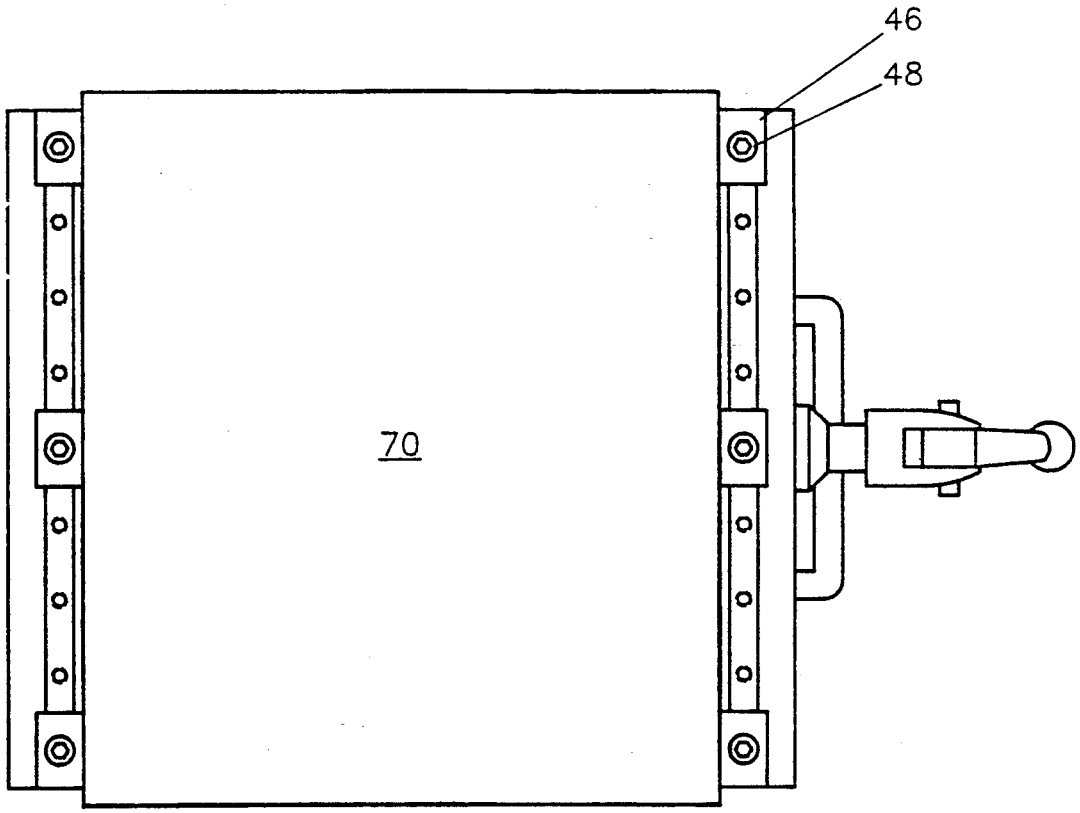
FIG. 3A is a plan view of the vise of FIG. 3 holding a larger workpiece.
Figure 3:
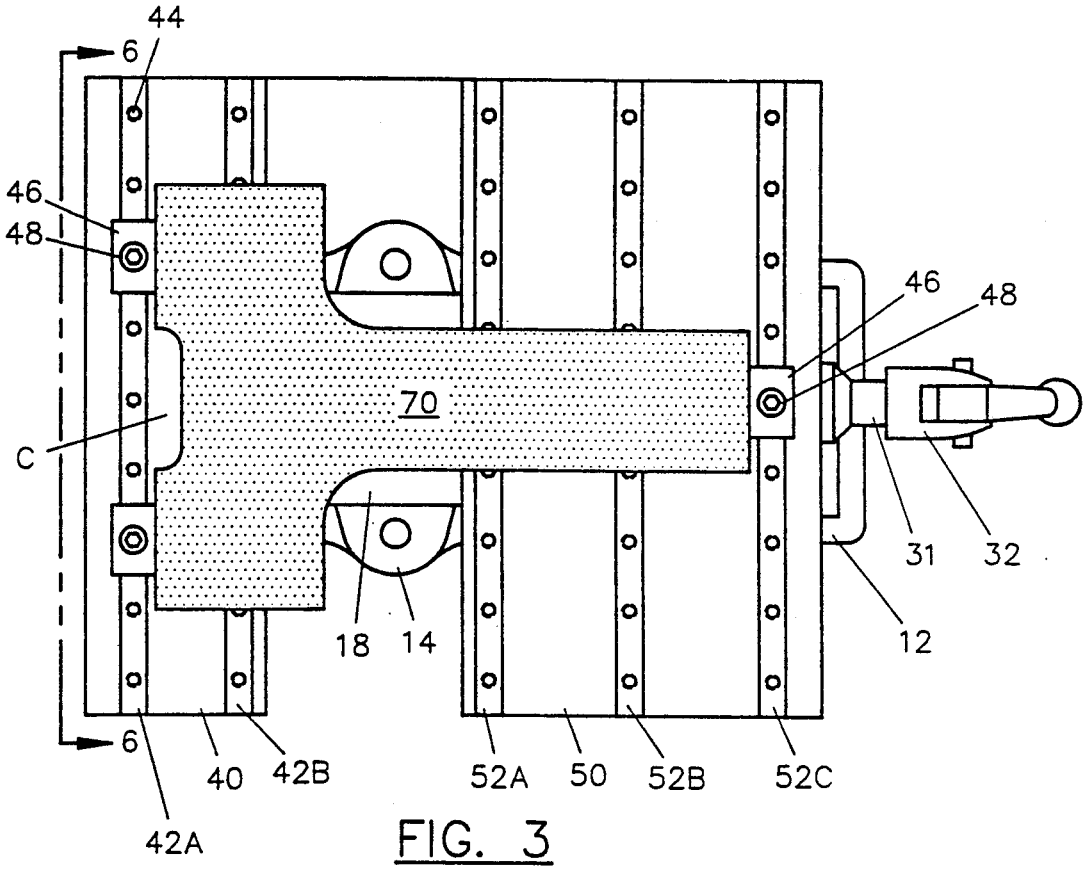
FIG. 3 is a plan view of a first embodiment of the invention as applied to the vise of FIG. 1 with a workpiece being held thereon.
Figure 4:
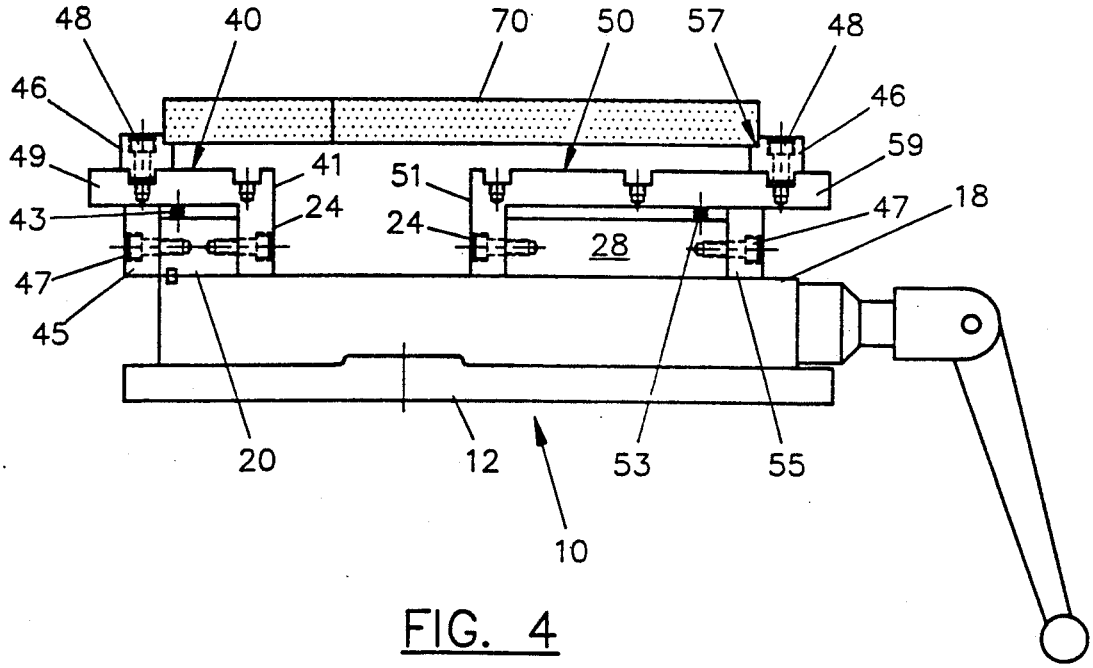
FIG. 4 is a side elevation of the vise of FIG. 3.
Figure 6:
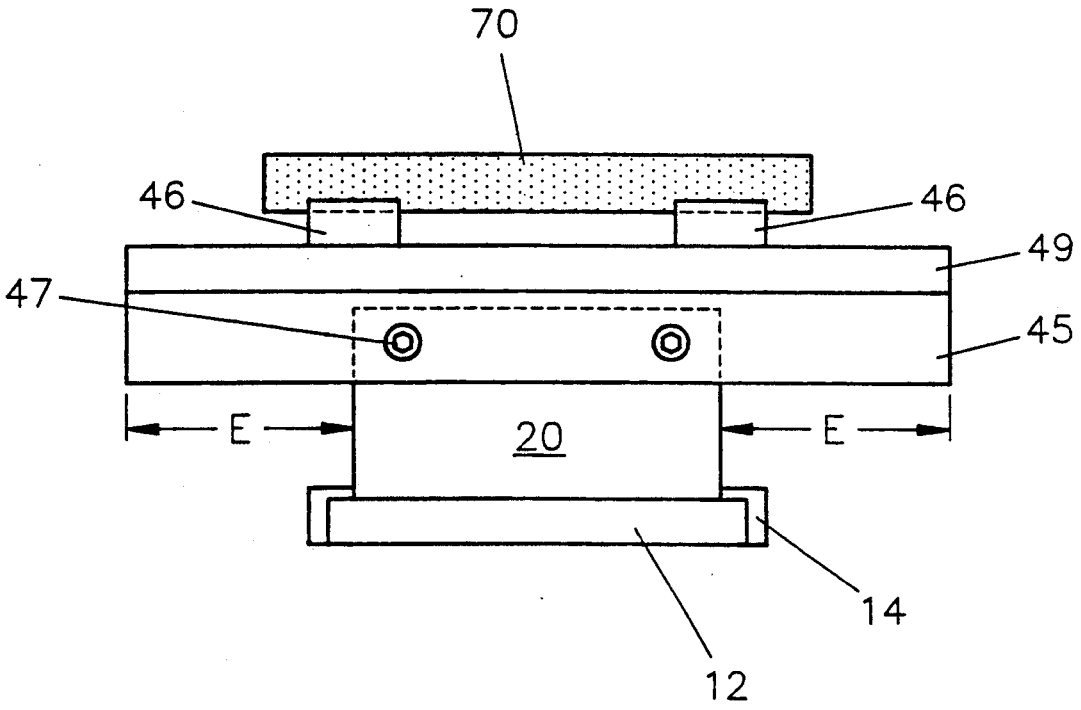
FIG. 6 is an end view of the vise of FIG. 3 when viewed along line 6—6.

FIGS. 3, 4 and 6 show a preferred embodiment of the invention. Throughout the description, like elements have been identified by like reference numbers.

Vise 10 is substantially one as known in the art and described above with respect to FIGS. 1 and 2. In the shown embodiment, jaw plates 22, 26 have been removed. Replacing the jaw plates are first extension member 49 and second extension member 59. First extension member 49 is attached to stationary jaw 20 by means of screws 24 and second extension member 59 is attached to movable jaw 28 also by means of screws 24. Each extension member 49, 50 has a base leg with front faces 41, 51 that replace jaw plates 22, 26 as facing surfaces respectively. Disposed at right angles to front faces 41, 51, and extending away from one another, are horizontal or extender legs of extension members 49, 59.

On upper surfaces 40, 50 of the horizontal legs of extension members 49, 59, respectively, are found rectangularly shaped key-ways. The rectangularly shaped key-ways have a flat bottom surface and sides perpendicular to the bottom surface. As shown in FIGS. 3 and 4, upper surface 40 includes key-ways 42A, 42B and upper surface 50 has three parallel key-ways 52A, 52B, 52C. For the sake of brevity, when referring to common features of the key-ways, only the numerical reference number will be used and that is to be understood to represent each of the separate key-ways identified by an alphabetic designation. The number of key-ways in upper surfaces 40 and 50 are a function of vice size and size of the workpiece to be machined. However, for most standard size machinist vises two key-ways in upper surface 40 and three key-ways 52 in upper surface 50 provide the necessary flexibility to machine a wide range of sizes and shapes for workpieces.

In the bottom surface of key-ways 42, 52 are threaded receptacles 44. Threaded receptacles 44 are preferably spaced equi-distantly along the length of each key-way. Further, the lateral dimension, or width, of extension members 49, 59 is such that they extend a distance "e" (FIG. 6) beyond each side of the jaw to which they are attached.

Figure 5A:
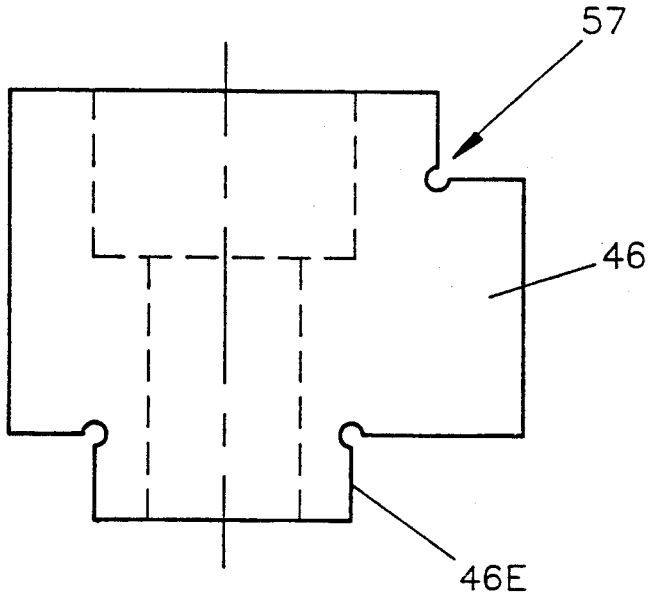
FIG. 5A is a side view of a jaw segment for use with the first embodiment.
Figure 5B:
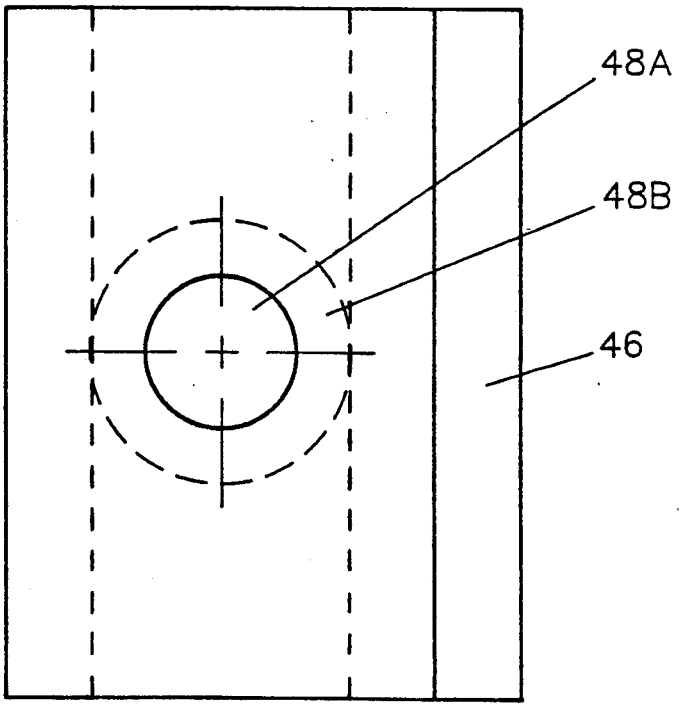
FIG. 5B is a plan view of a jaw segment for use with the first embodiment.

Jaw segments 46 are slidably received in key-ways 42A, 42B, 52A, 52B, 52C, as necessary, to fixedly hold workpiece 70. Received in each jaw segment 46 is screw 48 which passes through an opening 48A having a recess 48B in jaw segment 46 to be threadably received in a threaded receptacle 44. Extending from the lower surface of jaw segment 46 is a lateral key 46E (FIG. 5A). Key 46E is slidably received in key-ways 42, 52 but does not contact the bottom surface thereof. When tightened screw 48 solidly engages jaw segment 46 with extension member 49, 59 and the head of screw 48 fully seats in recess 48B (FIG. 5B). A cut-out 57 (FIGS. 4 and 5A) is provided at an upper corner of jaw segment 46, cut-out 57 providing a rest surface and a face for engaging a workpiece 70.

The jaw segments 46 can be located in the desired position in the key-ways 42, 52 to maximize the workpiece surface area capable of being machined. For example, in FIG. 3 two jaw segments 46 are located adjacent each corner of workpiece 70 to permit machining of the curved area "c" and in FIG. 3A six jaw segments 46 are used to hold a differently shaped workpiece 70.

Providing support to extension members 49, 59 are extension supports 45, 55 respectively. Extension support 45 is mounted to the back surface of stationary jaw 20 by means of screws 47. An upper surface of extension support 45 provides a support surface for a rearward lower surface of the horizontal leg of extension member 49. Intermediate of the front face 41 of the base leg of extension member 49 and the point of contact where the horizontal extender leg rests upon the upper surface of extension support 45 is adjusting screw 43 which provides intermediate support for the extension member 49. If the top surface of the stationary jaw is misaligned from the datum surface in any way, the adjusting screw is appropriately extended or withdrawn to maintain parallelism between the datum surface 18 and upper surface 40 while still providing intermediate support for the extension member 49. A similar adjusting screw 53 is provided on extension member 59.

Attached to the rear surface of movable jaw 28, by means of screws 47, is extension support 55. The upper surface of extension support 55 supports the horizontal leg of extension member 59. The lower surface of extension support 55 rests upon datum surface 18 of the vise. Because extension support 55 is fixed to movable jaw 28, it moves across datum surface 18 upon rotation of handle 32. Intermediate the front face 51 of the base leg of extension member 59 and the point where horizontal leg and extension support 55 are in contact is adjusting screw 53 for providing additional support to extension member 59. Adjusting screws 43, 53 also prevent warping or buckling of the horizontal legs of extension members 49, 59, respectively.

In operation of the invention, face plates 22 and 26 are removed from the jaws of vise 10. Extension support 45 is attached to the outside face of stationary jaw 20 and extension support 55 is attached to the outside face of movable jaw 28, both by means of screws 47. Extension member 49 is attached to the inner face of stationary jaw 20 by means of screws 24 and extension member 59 is attached to the inner face of movable jaw 28 also by means of screws 24.

The lower surface of the horizontal legs of extension members 49, 59 are received upon the upper surfaces of extension supports 45 and 55 respectively. Adjusting screws 43 and 53 are adjusted such that they make contact with the upper surface of the associated jaw and to provide upper surfaces 40, 50 are maintained parallel to datum surface 18.

The operator determines the number of jaw segments 46 to be placed in key-ways 42A, 42B or both and their desired location for engagement of one end of workpiece 70. Likewise the operator determines where jaw segments 46 need to be placed in key-ways 52A, 52B, 52C. Jaw segments 46 are placed within the key-ways 42,52 and locked into position by means of screws 48 which are screwed into the appropriate threaded receptacle 44. Movable jaw 28 is moved, by means of handle 32 and adjusting screw 30, such that workpiece 70 is loosely seated in cut-outs 57 of jaw segments 46. When the workpiece 70 is so seated, handle 32 is turned to move movable jaw 28 toward stationary jaw 20 to tightly clamp workpiece 70 between jaw segments 46. Workpiece 70 is now positioned for machining with jaw segments 46 offering little or no interference with the machining tool.

Figure 7:
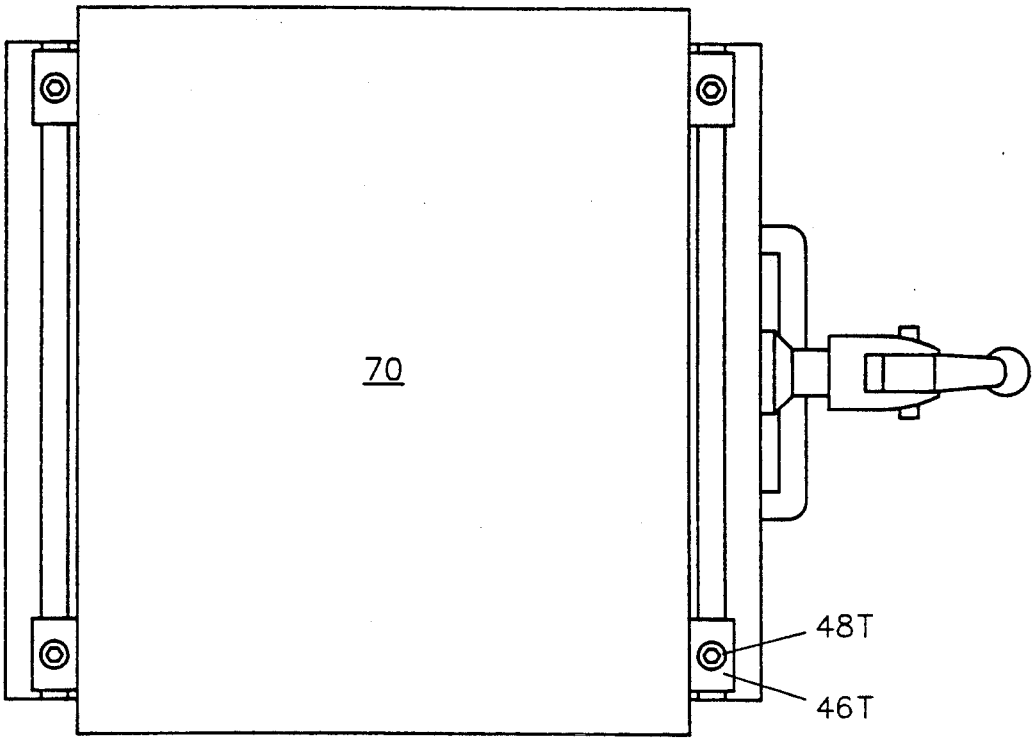
FIG. 7 is a plan view of a second embodiment of the invention.
Figure 8:
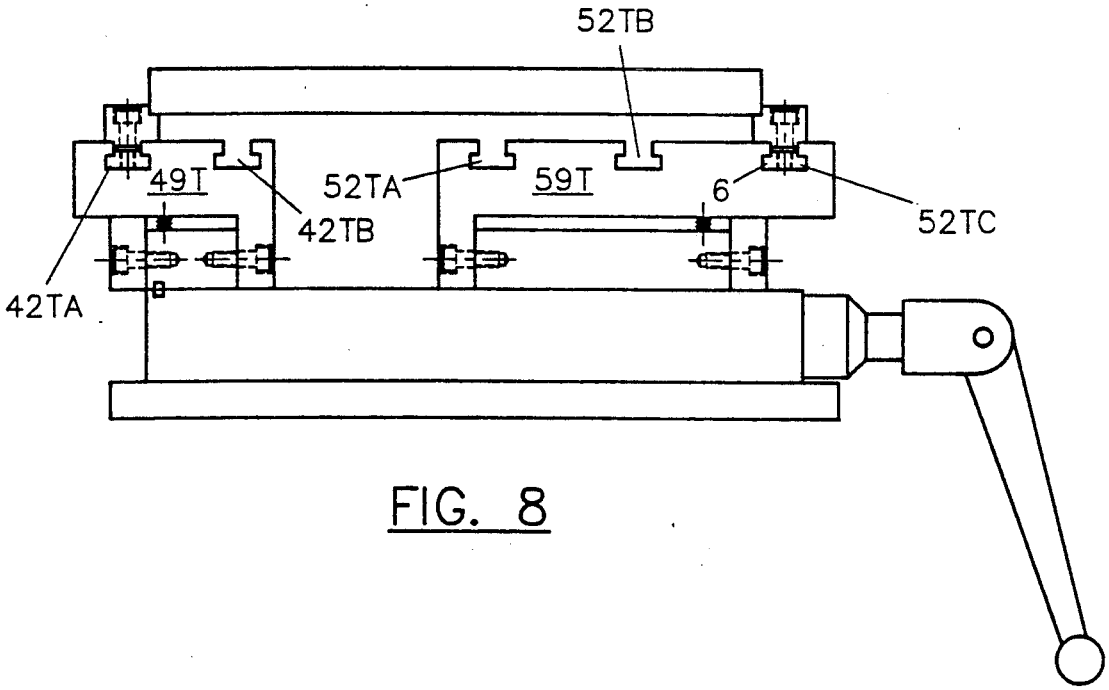
FIG. 8 is a side view of the vise of FIG. 7.

FIGS. 7 and 8 show a second embodiment of the invention. Rather than the rectangularly shaped key-ways having threaded receptacles 44 therein, inverted T-shaped key-ways are used. Inverted T-shaped key-ways 42TA and 42TB are shown in the upper surface of extension member 49T and inverted T-shaped key-ways 52TA, 54TB, 52TC are found in the upper surface of extension member 59T. The number of key-ways 42T, 52T is a function of vise size and the size and complexity of the workpieces to be machined.

Figure 9A:
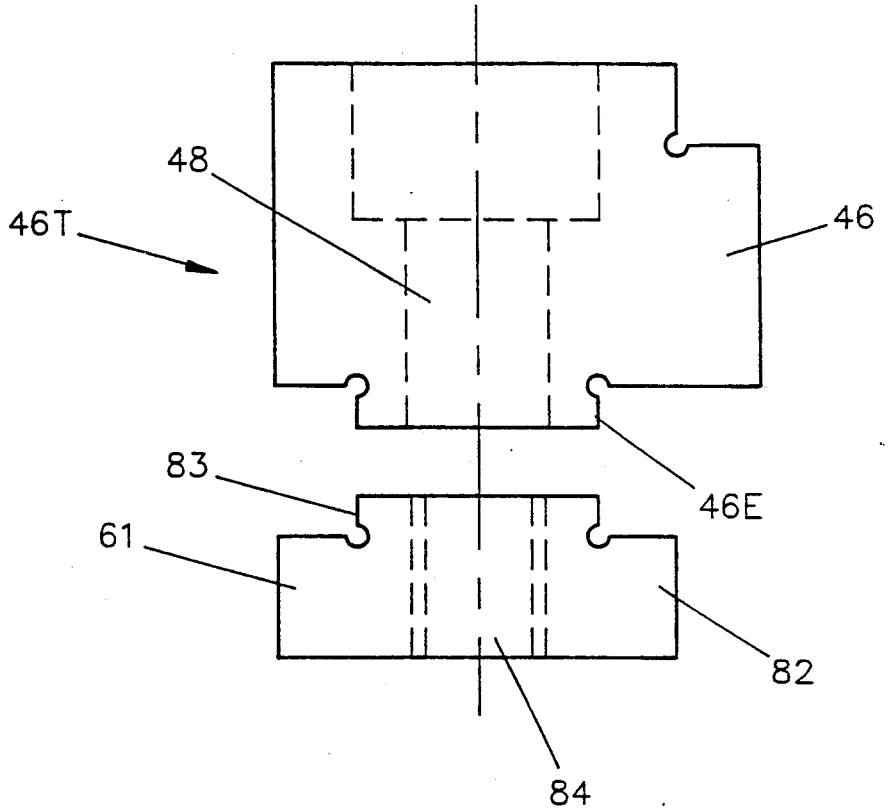
FIG. 9A is a side view of a jaw segment for use with the second embodiment.
Figure 9B:
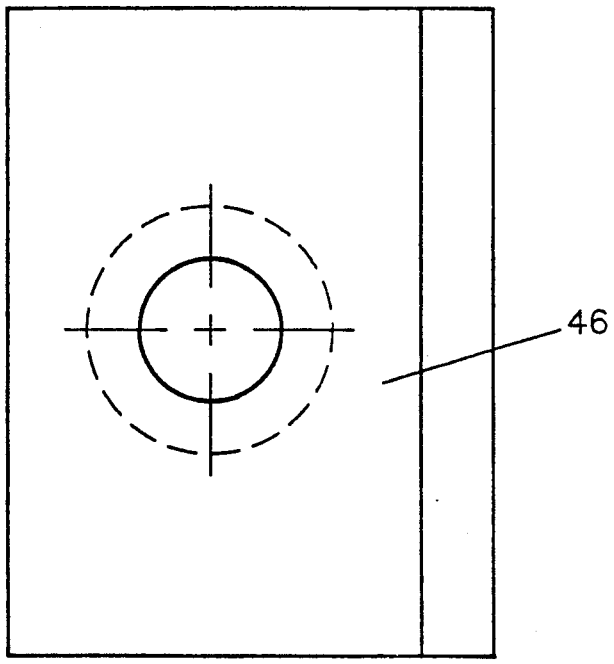
FIG. 9B is a plan view of a jaw segment for use with the second embodiment.

Jaw segments 46T, used with the second embodiment of FIGS. 7 and 8, are shown in FIGS. 9A and 9B. Jaw segments 46T comprise an upper 46 and lower 82 portion. Upper portion 46 is the same as jaw portion 46 shown in FIGS. 5A and 5B. Lower portion 82 comprises a T-shaped nut segment having lateral extensions 61 and a vertical extension 83. Lateral extensions 61 are complementary to the crossed arm of the inverted T-shaped key-ways 42T, 52T and upward extending key 83 is sized to be slidably received in the stem of inverted T-shaped key-ways 42T, 52T. Key 83 opposes downward extending key 46E of upper portion 46, their combined length being slightly less than the length of the stem of inverted T-shaped key-ways 42T, 52T. Screw means 48T pass vertically through the opening 48 in upper portion 46 and are threadably received in opening 84 of lower portion 82. Thus, by tightening screw means 48T, lower portion 82 is drawn upwardly and upper portion 46 is drawn downwardly to tightly engage the flanges of inverted T-shaped key-way 42T, 52T in which jaw segment 46T is mounted.

Figure 10:
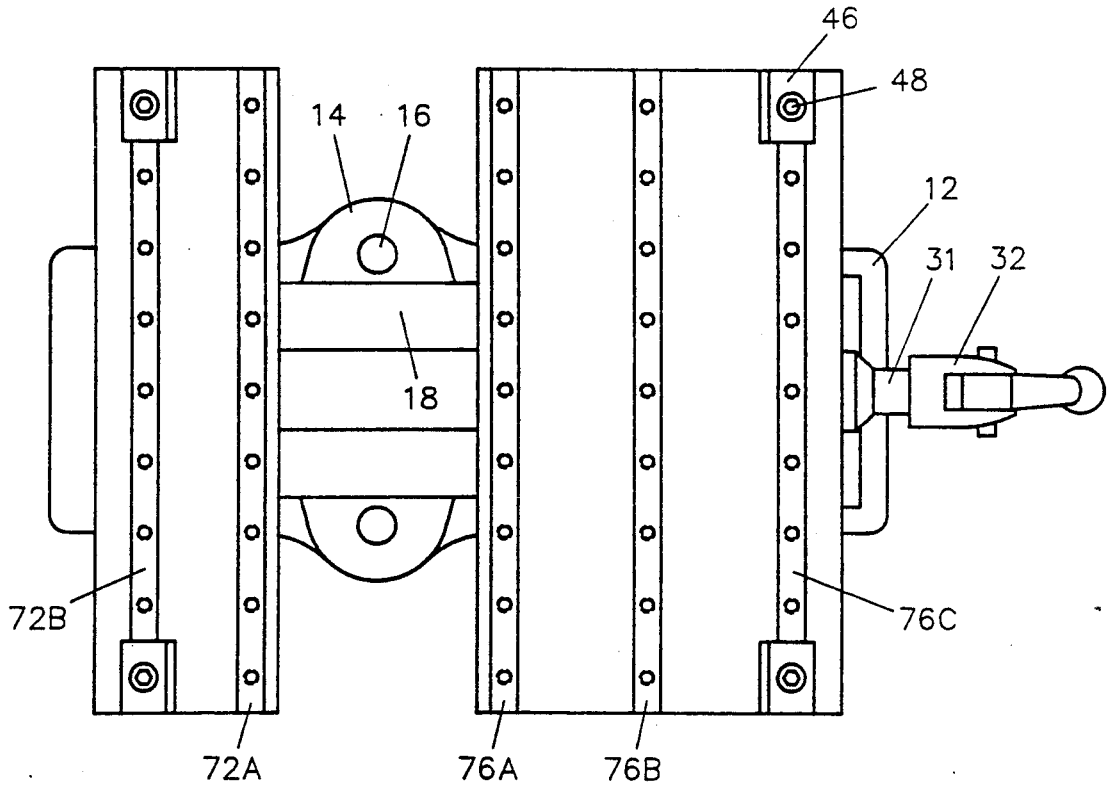
FIG. 10 is a plan view of a third embodiment of the invention.
Figure 11:
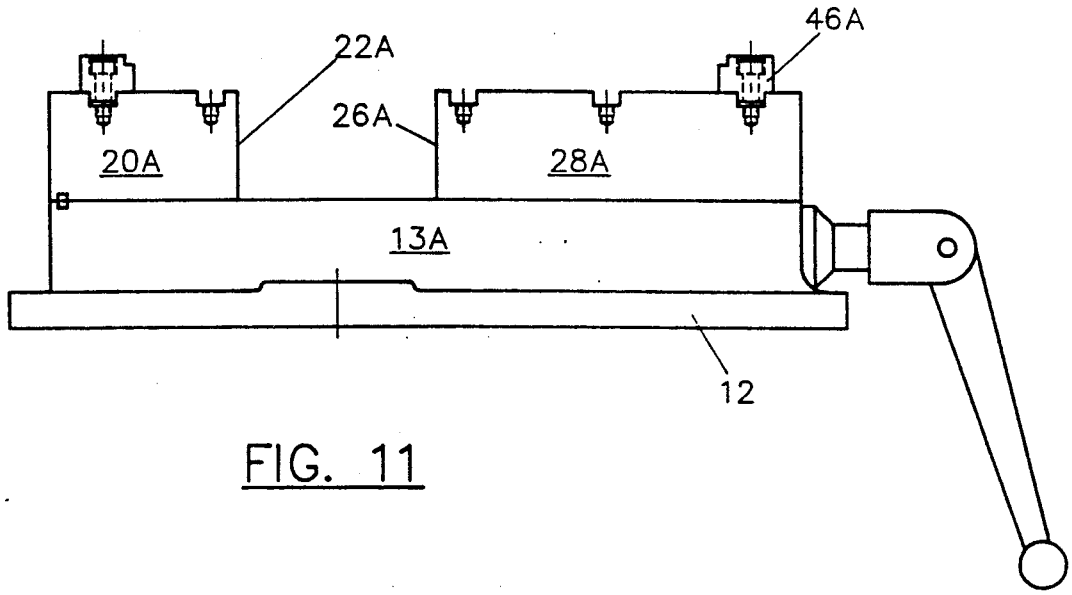
FIG. 11 is a side elevation of the vise of FIG. 10.

A third embodiment of the invention is shown in FIGS. 10 and 11. In this embodiment, movable jaw 28A replaces movable jaw 28 and stationary jaw 20A replaces stationary jaw 20 of vise 10. Movable jaw 28A incorporates, as a solid construction, the movable jaw, the extension member and the extension support. On the upper surface of movable jaw 28A are three rectangularly shaped key-ways 76A, 76B, 76C for receiving jaw segments 46. Likewise, stationary jaw 20A combines the stationary jaw, the extension member and the extension support into a solid construction having rectangularly shaped key-ways 72A, 72B on the upper surface thereof. Equally spaced along the longitudinal axis of key-ways 72, 76 are threaded receptacles 44. Jaws segments 46, having threaded retention means 48, are placed in an appropriate key-way 72, 76 and locked into the desired position by the tightening of threaded retention means 48 into one of the threaded receptacles 44. Alternatively, this embodiment could be provided with inverted T-shaped key-ways and jaw segments 46T. In either case, movable jaw 28A is moved by means of rotation of adjustment screw 32A as described with respect to the first embodiment of the invention.

Although stationary jaw 20A and movable jaw 28A are shown as formed with facings 22A, 26A respectively, jaw plates could be mounted thereto as previously described with respect to jaw plates 22 and 26.

Figure 12:
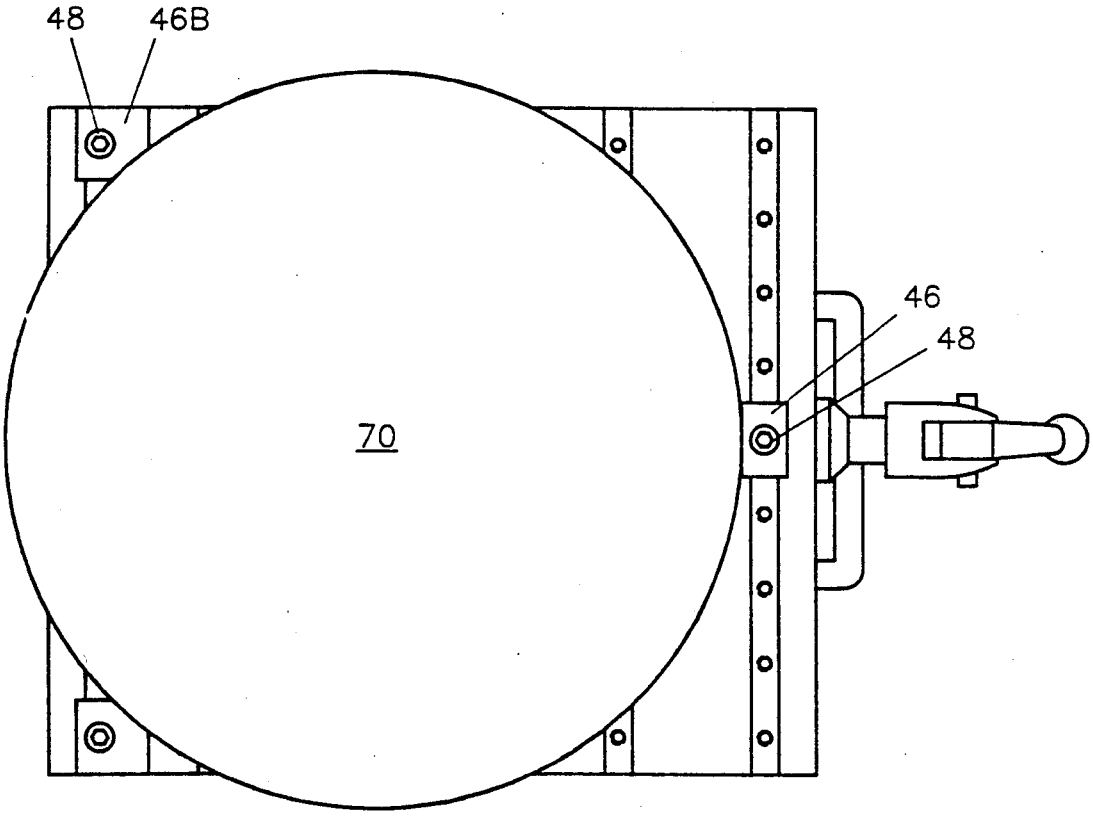
FIG. 12 is a plan view of a vise holding a workpiece having non-straight edges.
Figure 13A:
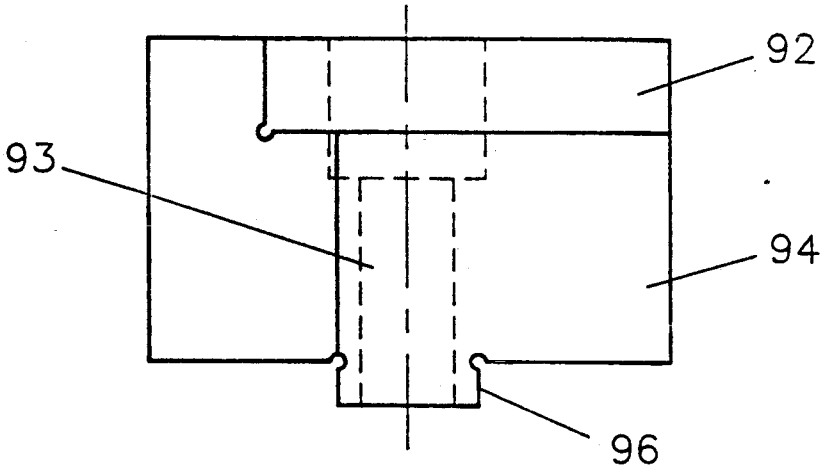
FIG. 13A is a side view of a V-jaw segment.
Figure 13B:
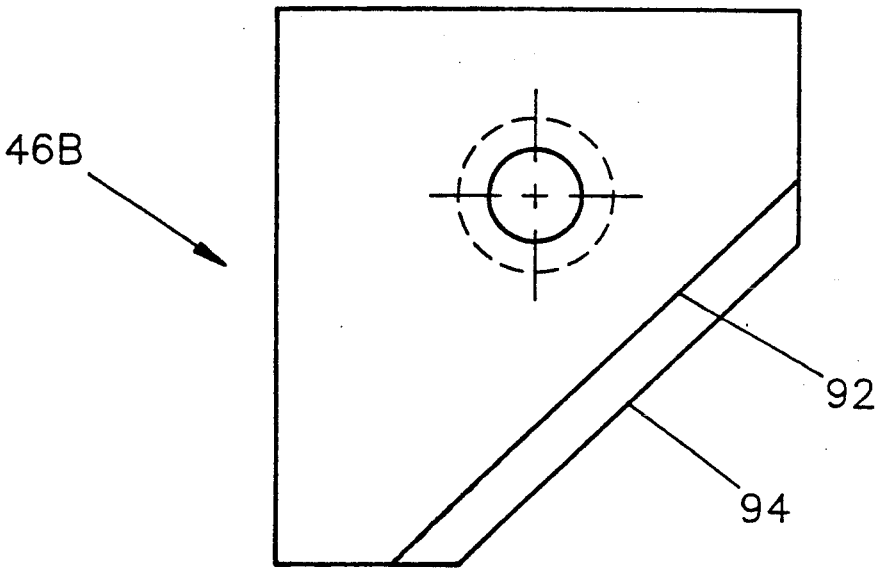
FIG. 13B is a plan view of a V-jaw segment.
Figure 14A:
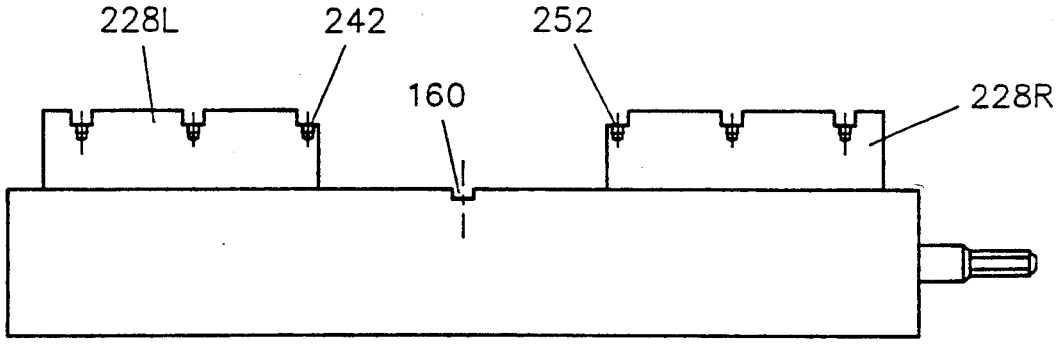
FIG. 14A is a side elevation of a double vise with provision for a removable centrally located stationary jaw to which the invention is applied.
Figure 14B:
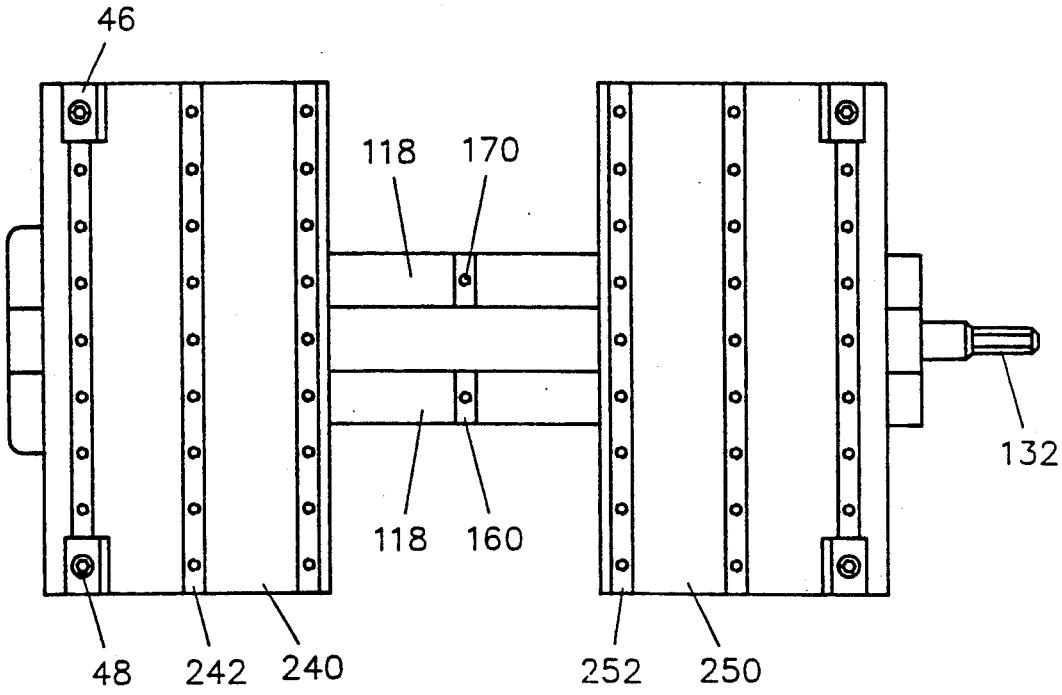
FIG. 14B is a plan view of a vise of FIG. 14A.
Figure 15A:
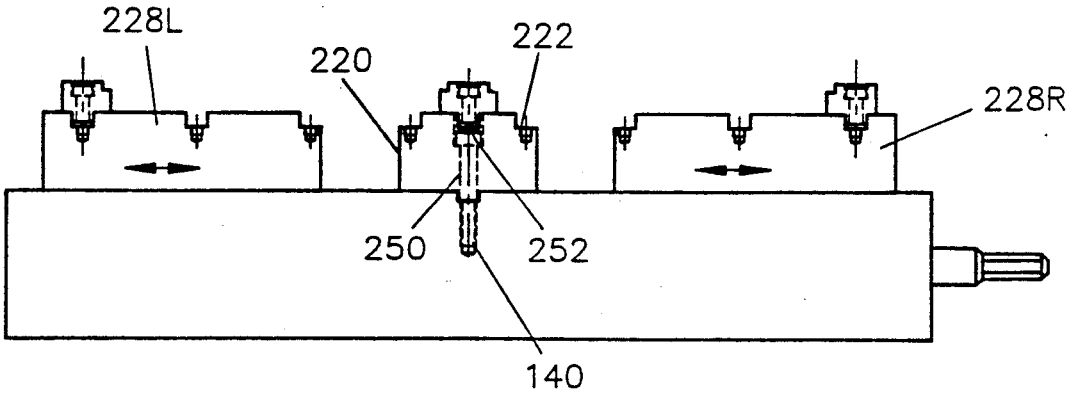
FIG. 15A is a side elevation of the vise of FIG. 14A having a removable stationary jaw having an embodiment of the invention integral thereto.
Figure 15B:
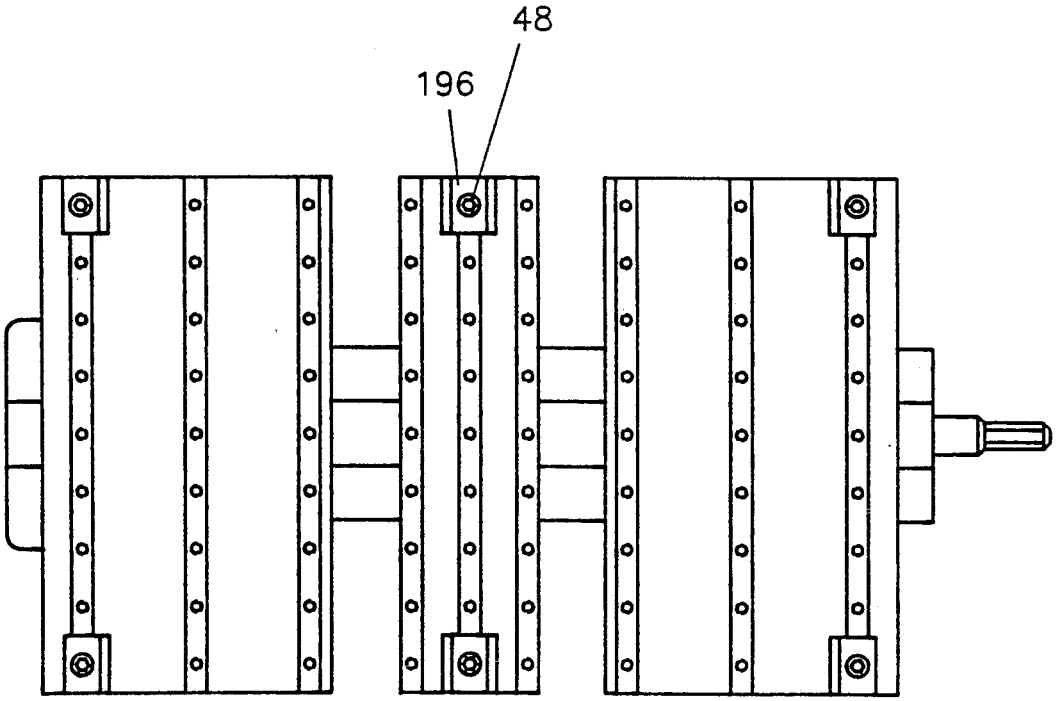
FIG. 15B is a plan view of a vise of FIG. 15A.

In order to properly retain oddly shaped workpieces for machining, such as circular workpiece 70 of FIG. 12, jaw segments 46B are provided. Jaw segments 46B may be adapted for use with either inverted T-shaped key-ways or rectangular key-ways. As shown in FIGS. 13A and 13B, jaw segments 46B are adapted for use with rectangular key-ways. As such, they have lateral keys 96 on their bottom surface for receipt in key-ways of the embodiments of FIGS. 3, 4, 10 and 11. As shown in FIG. 13B, a triangularly shaped section has been removed from one corner. The corner having the section removed defines the engagement face of jaw segment 46B and has a cut-out 92 at an upper aspect thereof for retaining the workpiece. The jaw segment shown in FIGS. 13A and 13B is a right hand jaw segment and would be used as shown in the upper left portion of FIG. 12. A mirror shaped jaw segment 46B, a left hand jaw segment, would be used as shown in the lower left portion of FIG. 12. Alternatively, jaw segment 46B might be configured to have both left and righthand jaw faces for the retention of a workpiece and thereby be capable of placement on either side of an irregularly shaped workpiece.

The jaw segments 46, 46B, and 46T may be of any composition suitable to the machining task. Thus, for working metallic materials jaw segments 46, 46B and 46T would normally be of a hard metal such as stainless steel. For some machining needs, jaw segments 46, 46B, and 46T would normally be made of plastic, hard rubber, aluminum or machinable steel that would not damage the workpiece held therein. Such jaw segments may be configured without work-piece retention notches so that a user may machine notches as pockets therein to retain oddly configured workpieces. Likewise, extension members 49, 59 and 49T, 59T, although normally made of a hard metal, could as well be made of a machinable material depending on the use to which the vise is put. The jaw plates applied to faces 22A and 26A, of the third embodiment, could also be of a hard metal, synthetic resin or rubber.

FIGS. 14A–16B illustrated application of the invention to a double jaw vise, that is, a vise having two opposing movable jaws that normally move symmetrically with respect to one another upon rotation of handle 132. Centrally located between the opposing inner-faces of movable jaws 128L, 128R (FIGS. 16A, 16B) and 228L, 228R (FIGS. 14A–15B) may be a stationary jaw. The stationary jaw may be a fixed jaw rigidly attached to datum surface 118 or may be a removable stationary jaw such as portrayed in FIGS. 14A–16B. In either case, the stationary jaw has finished jaw faces opposing the inner faces of the two movable jaws.

As seen in FIGS. 14A–15B, the device comprises opposing movable jaws 228L, 228R having upper surfaces 240 and 250 respectively. Upper surface 240 is provided with key-ways 242 and upper surface 250 with key-ways 252. Although shown as rectangularly shaped key-ways, these may be of an inverted T-shape as shown in FIG. 8.

Intermediate of movable jaws 228L, 228R on the upper surface of datum surface 118 is rectangularly shaped key-way 160. Key-way 160 is parallel to the inner faces of movable jaws 228L, 228R and, for the symmetrically moving jaws, is equal distance therefrom. Within key-way 160 are threaded receptacles 170.

Stationary jaw 220 has a rectangularly shaped extension extending from its bottom surface that is complementary to key-way 160 and is received therein when stationary jaw 220 is mounted on datum surface 118. Stationary jaw 220 is affixed to the vise by means of screws 252 mounted in openings 250 and threadably received in threadable receptacles 170. The upper surface of stationary jaw 220 has key-ways 222 on the upper surface thereof. These key-ways may be rectanguarly shaped or inverted T-shaped.

Key-ways 222, 242 and 252 are capable of receiving complementary jaw segments 46 in the manner previously discussed. Additionally, jaw segments 196, which may have either a rectangularly shaped lower extension or an inverted T-shaped lower portion, may be mounted in key-ways 222 of stationary jaw segment 220 by retention means 48. Jaw segments 196 may have a cut-out at the upper corners facing the opposing movable jaws for receiving a workpiece therein.

Figure 16A:
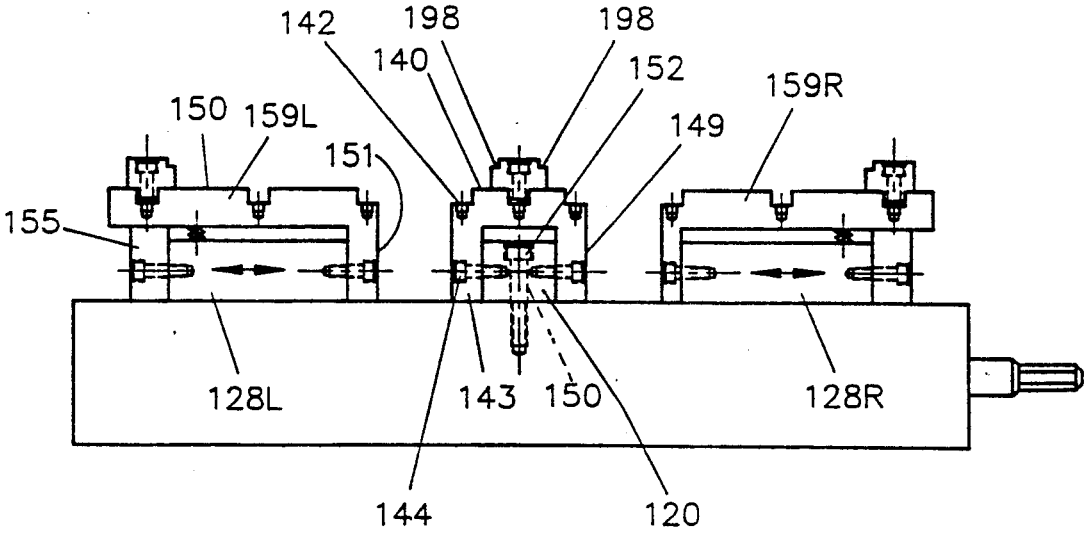
FIG. 16A is a side elevation of the vise of FIG. 14A with a second embodiment of the stationary jaw employing the invention.
Figure 16B:
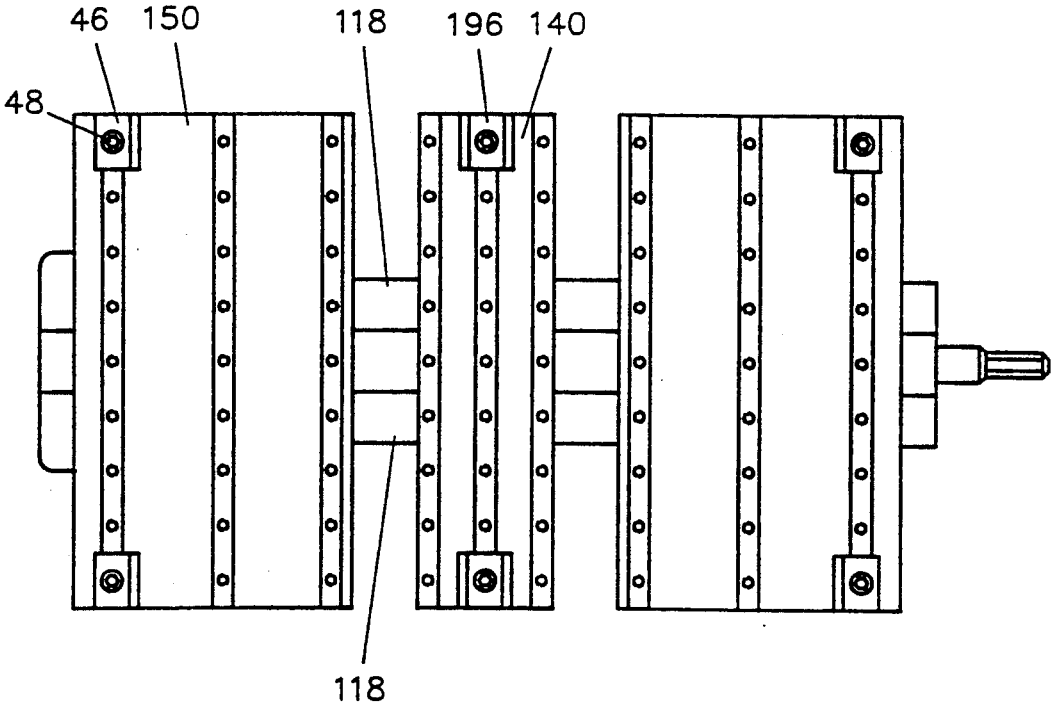
FIG. 16B is a plan view of the vise of FIG. 16A.

FIGS. 16A and 16B show a double vise using vise jaw extensions similar to those discussed in conjunction with FIGS. 3 and 4. Extension members 159L, 159R are mirror images of one another and are mounted and used in the same manner as discussed with respect to extension member 59. In this embodiment, however, stationary jaw 120 corresponds to stationary jaw 20 of FIG. 3. Stationary jaw 120 is mounted in the same manner as stationary jaw 220 of FIG. 15A. However, there are no key-ways on the upper surface of stationary jaw 120. The key-ways are provided in jaw extension 149. Jaw extension 149 has the shape of an inverted block-U. The downwardly extending arms 143 are received on either side of stationary jaw 120 and affixed thereto by retention means 144. The upper surface 140 of extension member 149 has keyways 142 for receiving jaw segments 196. Alternatively, any jaw segment having a lower portion complementary to the key-way may be used with extension member 149.

Although the present invention has been described with several embodiments, these embodiments are intended to be illustrative, not limiting. Various modifications may be made without departing from the spirit and scope of the invention as defined in the appended claims.

What is claimed is:

1. Jaw extensions for a vise for machining operations, the vise having a stationary jaw with an inner face and an outer face, a movable jaw with an inner face and an outer face, the inner faces of the stationary and movable jaws facing one another, a flat datum surface upon which the movable jaw rests, and means for adjusting a position of the movable jaw relative to the stationary jaw, comprising:

a first extension assembly for the stationary jaw;

a second extension assembly for the movable jaw; and a plurality of jaw segments, at least one jaw segment of said plurality of jaw segments being mounted on each of said first and said second extension assemblies, said at least one jaw segment capable of fixation where mounted, each of said first and said second extension assemblies further comprises an L-shaped extender, said L-shaped extender having a base leg perpendicular to the datum surface and an extender leg parallel to the datum surface, said extender leg has at least one laterally extending key-way in an upper surface for receiving at least one jaw segment;

wherein at least the second extension assembly includes an extension support removable affixed to the outer face of the movable jaw for supporting, at an end opposite said base leg, the extender leg of the second extension assembly relative to the datum surface.

2. Jaw extensions as claimed in claim 1 wherein said base leg of said L-shaped extender is removably affixed to an inner surface of the jaw and the width of said L-shaped extender extends beyond the width of the jaw.

3. Jaw extensions as claimed in claim 1 wherein an end of said base leg rests on the datum surface.

4. Jaw extensions as claimed in claim 1 wherein said extension supports have a flat top and a flat bottom surface, said flat top surface providing the support to said end of said extender leg.

5. Jaw extensions as claimed in claim 4 wherein said flat bottom surface of said extension support affixed to said movable jaw slidably rests on the datum surface.

6. Jaw extensions as claimed in claim 1 further comprising a plurality of threaded receptacles in said at least one key-way.

7. Jaw extensions as claimed in claim 1 wherein said extender leg associated with said movable jaw has at least two laterally extending key-ways.

8. Jaw extensions as claimed in claim 1 wherein said laterally extending key-ways are inverted T-shaped.

9. Jaw extensions as claimed in claim 6, wherein at least one of said jaw segments is received in the key-way in said extender leg, said jaw segments further comprising a set screw passing through said jaw segment, said set screw providing means for fastening said jaw segment in position in said key-way by engaging one of said plurality of threaded receptacles.

10. Jaw extensions as claimed in claim 1, wherein each said jaw segment, further comprises a cut-out means for engaging and supporting a workpiece.

11. Jaw extensions as claimed in claim 8, said jaw segments further comprising an upper portion, a T-nut for being slidably received in arms of said inverted T-shaped key-ways; a cut-out means for contacting a workpiece; and retention means for locking said jaw segment in position in one of said inverted T-shaped key-ways.

12. Jaw extensions as claimed in claim 11 wherein said retention means comprises a set screw passing through said upper portion to be threadably engaged in said T-nut.

13. Jaw extensions for a vise for machining operations, the vise having a stationary jaw with an inner face and an outer face, a movable jaw with an inner face and an outer face, the inner faces of the stationary and movable jaws facing one another, a flat datum surface upon which the movable jaw rests, and means for adjusting a position of the movable jaw relative to the stationary jaw, comprising:

a first extension assembly for the stationary jaw;

a second extension assembly for the movable jaw; and a plurality of jaw segments, at least one jaw segment of said plurality of jaw segments being mounted on each of said first and said second extension assemblies, said at least one jaw segment capable of fixation where mounted;

wherein said first extension assembly further comprises: at least one laterally extending key-way in an upper surface of the first extension assembly for locating a jaw segment, said key-way having a flat bottom surface and sides perpendicular to said flat bottom surface; and a plurality of threaded receptacles in said bottom surface of said key-way, said threaded receptacles being equally spaced apart one from the other;

said second extension assembly further comprising: at least two laterally extending key-ways in an upper surface of the second key assembly for locating a jaw segment, said at least two key-ways lying parallel one to the other and having flat bottom surfaces with sides perpendicular to said bottom surfaces, each of said key-ways having a plurality of threaded receptacles therein, said threaded receptacles spaced equally apart one from the other.

14. Jaw extensions as claimed in claim 13, each of said jaw segments further comprising a set screw passing through said jaw segment, said set screw providing means for fastening said jaw segment in position in one of said key-ways by engaging one of said plurality of threaded receptacles.

15. Jaw extensions as claimed in claim 1 wherein said first extension assembly further comprises at least one laterally extending key-way in an upper surface of said first extension assembly, said key-way having an inverted T-shaped configuration; and said second extension assembly further comprises at least two laterally extending key-ways in an upper surface of said second extension assembly, said at least two key-ways lying parallel one to the other and having an inverted T-shaped configuration.

16. Jaw extensions as claimed in claim 15, wherein said jaw segments further comprise an upper portion, a T-nut for being slidably received in arms of said inverted T-shaped key-ways; an opening passing through said upper portion in a direction perpendicular to said datum surface; and a set screw passing through said opening to be threadably engaged by said T-nut.

17. A vise for use with machining tools, the vise comprising:

a base providing a datum surface and having a stationary jaw at one end of said datum surface, an inner face of said stationary jaw being perpendicular to said datum surface;

a movable jaw slidably received on said datum surface, an inner face of said movable jaw being perpendicular to said datum surface;

adjustment means for moving said movable jaw along said datum surface relative to the stationary jaw to open and close the vise jaws, the distance between the inner faces of the stationary and movable jaws defining a throat distance;

jaw extension means for increasing the throat distance, said jaw extension means comprising:

a stationary jaw assembly comprising an L-shaped extension member having a base leg mounted to said inner face of said stationary jaw and an extension leg overlying a top surface of said stationary jaw, said extension leg having a key-way on an upper surface thereof and an extension segment, said extension segment attached to an outer face of said stationary jaw, an upper surface of said extension segment supporting an end of said extension leg opposite said base leg;

a movable jaw assembly comprising a L-shaped extension member having a base leg mounted to said inner face of said movable jaw and an extension leg overlying a top surface of said movable jaw, said extension leg having at least one key-way on an upper surface thereof and an extension segment, said extension segment attached to an outer face of said movable jaw, a lower surface of said extension segment being in contact with the datum surface and an upper surface supporting an end of said extension leg opposite said base leg, said key-ways have a flat bottom surface and sides perpendicular to said flat bottom surface;

a plurality of jaw segments, a lower surface of said jaw segments being complementary to said key-ways for being received therein, said jaw segments having cutout means for holding a workpiece; and retention means for securely fixing said jaw segments in a desired position along said key-ways, said retention means comprising a plurality of threaded holes in said bottom surface of said key-way and a set screw retained in said jaw segment, said set screw threadably engaging one of said plurality of threaded holes.

18. Jaw extensions as claimed in claim 1 wherein said jaw segments comprise an engagement face having a cut-out for receiving a workpiece disposed at an angle to a longitudinal axis of the key-way in which said jaw segment is mounted.

19. Jaw extensions as claimed in claim 13 wherein said first extension assembly is integral to the stationary jaw and said second extension assembly is integral to the movable jaw.

20. Jaw extensions as claimed in claim 15 wherein said first extension assembly is integral to the stationary jaw to form a one piece stationary jaw and said second extension assembly is integral to the movable to form a one piece movable jaw.

21. A vise as claimed in claim 17 wherein said base leg of said L-shaped extension member mounted to and the extension segment attached to the stationary and movable jaws respectively are removable.

22. A vise as claimed in claim 17 wherein said base leg of said L-shaped extension member mounted to and the extension segment attached to the stationary and movable jaws respectively are integral therewith so as to form a one piece extended jaw.

23. A vise as claimed in claim 21 further comprising an adjustment screw threadably received through said extension leg of said L-shaped extension member mounted to the stationary and movable jaws respectively for contacting a top surface thereof.

24. Jaw extensions for a vise for machining operations, the vise having a stationary jaw with an inner face and an outer face, a movable jaw with an inner face and an outer face, the inner faces of the stationary and movable jaws facing one another, a flat datum surface upon which the movable jaw rests, and means for adjusting a position of the movable jaw relative to the stationary jaw, comprising:

a first extension assembly for the stationary jaw;

a second extension assembly for the movable jaw; and a plurality of jaw segments, at least one jaw segment of said plurality of jaw segments being mounted on each of said first and said second extension assemblies, said at least one jaw segment capable of fixation where mounted;

wherein each of said first and said second extension assemblies further comprises:

an L-shaped extender, said L-shaped extender having a base leg perpendicular to the datum surface and an extender leg parallel to the datum surface overlying an associated jaw and each said extender leg having at least one laterally extending key-way in an upper surface for receiving at least one jaw segment and having a plurality of threaded receptacles in said at least one key-way.

25. Jaw extensions as claimed in claim 13, wherein at least the second extension assembly includes an extension support adjacent the outer face of the movable jaw for supporting the second extension assembly on the datum surface.

26. Jaw extensions as claimed in claim 24, wherein at least the second extension assembly includes an extension support adjacent the outer face of the movable jaw for supporting the second extension assembly on the datum surface.

27. Jaw extensions as claimed in claim 24, wherein said first and said second extension assemblies further comprise an adjusting screw threadably received in said extender leg.

28. Jaw extensions for a vise as claimed in claim 24, wherein the vise further comprises: a second movable jaw resting on the datum surface away from the movable jaw with the stationary jaw therebetween, the second movable jaw having an inner and outer face, the outer face of the stationary jaw comprising a second inner face facing the inner face of the second movable jaw, and the adjusting means moving a position of each movable jaw symmetrically with respect to the stationary jaw; and a third extension assembly for said second movable jaw.

29. Jaw extensions as claimed in claim 28, wherein said first extension assembly is integral to said stationary jaw, said second extension assembly is integral to said movable jaw and said third extension assembly is integral to said second movable jaw so as to form one piece extendible jaws.

30. Jaw extensions as claimed in claim 13, wherein said first and said second extension assemblies further comprise an adjusting screw threadably received in said extender leg.

31. Jaw extensions as claimed in claim 28, wherein said stationary jaw is removably affixed to the datum surface.

32. Jaw extensions as claimed in claim 28, wherein said third extension assembly further comprises an L-shaped extender, said L-shaped extender having a base leg perpendicular to the datum surface and an extender leg parallel to the datum surface; and an adjusting screw, said adjusting screw threadably received in said extender leg wherein the extension support supports said extender leg at an end opposite said base leg.

33. Jaw extensions as claimed in 28, wherein said L-shaped extender of said first extension assembly further comprises a second base leg spaced apart from said base leg to create an inverted block U-shaped extender, said U-shaped extender having parallel legs perpendicular to the datum surface and inner surfaces adjacent the faces of the stationary jaw.

34. Jaw extensions as claimed in claim 33, wherein said parallel legs of said inverted block U-shaped extender are removably affixed to the faces of a stationary jaw.

35. Jaw extensions as claimed in claim 33, wherein said inverted block U-shaped extender has at least one laterally extending key-way in an upper surface for receiving at least one jaw segment.

36. Jaw extensions as claimed in claim 32, wherein said extender leg of said third extension assembly has at least one laterally extending key-way in an upper surface for receiving said at least one jaw segment.

37. Jaw extensions as claimed in claim 33, wherein said first extension assembly is integral to said stationary jaw, an upper surface of said stationary jaw having at least one laterally extending key-way for receiving at least one jaw segment.

* * * * *